United States Patent [19]

Lord

[11] Patent Number: 4,499,841

[45] Date of Patent: Feb. 19, 1985

[54] SAIL RIGGING AND CONTROL SYSTEM

[75] Inventor: John G. Lord, Tighlman Island, Md.

[73] Assignee: Lloyd Bergeson, Norwell, Mass.

[21] Appl. No.: 290,234

[22] Filed: Aug. 5, 1981

[51] Int. Cl.[3] ..... B63H 9/04

[52] U.S. Cl. ..... 114/98; 114/97; 114/90; 114/107

[58] Field of Search ..... 114/90, 97, 98, 106, 114/107, 39, 111; 212/253

[56] References Cited

U.S. PATENT DOCUMENTS

| | | | |
|---|---|---|---|
| 3,332,384 | 7/1967 | Potter | 114/106 |
| 4,061,101 | 12/1977 | Cook | 114/90 |
| 4,074,647 | 2/1978 | Delaney | 114/98 |
| 4,367,688 | 1/1983 | Godfrey | 114/107 |
| 4,407,419 | 10/1983 | Clements | 212/253 |

*Primary Examiner*—Trygve M. Blix
*Assistant Examiner*—C. Bartz
*Attorney, Agent, or Firm*—Robert E. Ross

[57] ABSTRACT

A sail support and control system designed for use as sail assist propulsion on a cargo vessel.

The system provides complete powered control of the amount of exposed sail, the angle of the sail in relation to the vessel, and clew outhaul and downhaul tension so that no manual handling of rigging is required.

8 Claims, 12 Drawing Figures

76
76
40
78
78
14
26
16
24
18
20
22
88
90

SAIL RIGGING AND CONTROL SYSTEM

BACKGROUND OF THE INVENTION

The increase in the cost of fuel has made the use of sail assist propulsion of cargo ships economically feasable, provided that no increase in manpower is required to handle the sails, since an increase in manpower of only about 20% would eliminate any economic advantage gained by the propulsion assistance of the sails.

Therefore there has been a great need for a sail and rigging system for propulsion assist that requires no additional manpower to operate, and can be operated by remote control from the ship's bridge.

SUMMARY OF THE INVENTION

This invention provides a sail support and control system designed for use as a propulsion system on a cargo vessel.

An unstayed mast is mounted on a ship so as to be rotatable in ralation thereto, and is provided with a cantilever boom. A motor and suitable winches are provided on the boom which take in and pay out sheets which extend from the end of the boom around suitably positioned fairleads to dead ends on the deck, to enable the boom to be swung to a desired position in relation to the ship, and to provide sheet tension to hold the boom in the desired lateral position. The cantilever mounting of the boom eliminates any requirement that the sheets provide downward tension against clew pull. A second motor is provided on the boom support and is geared to the mast so that operation of the motor causes rotation of the mast. When the motor is not operating, the boom and mast are locked in fixed relation to each other by said gearing.

Figure 1:
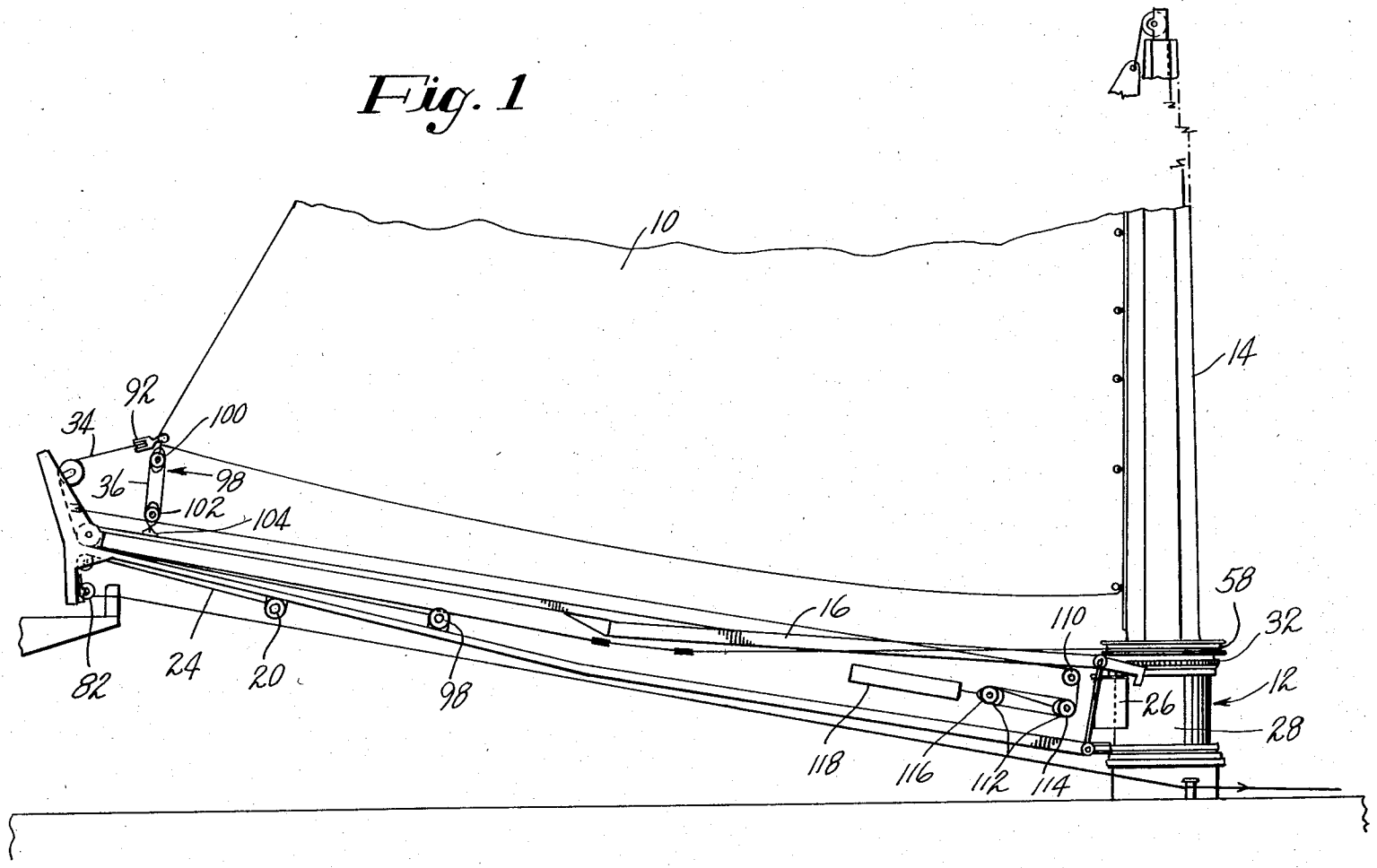
FIG. 1 is a view in side elevation of a sail rigging and control system embodying the features of the invention.

Swinging of the boom to a new angular position in relation to the ship therefore causes the mast to rotate a like amount so that a change in position of the boom does not change the amount of sail exposed.

Separate means are provided for applying outhaul and downhaul tension to the clew of the sail. Th outhaul tension line is payed out and taken in from a drum on the mast which is two times the mast diameter. The other end of the outhaul tension line is connected to the clew of the sail by a two part block,and then dead ended to a hydraulic cylinder or winch, so that a continuous tension may be applied to the line during sail reefing or unfurling. By maintaining continuous tension on the outhaul line, the horsepower requirement of the mast rotating motor is greatly reduced.

The downhaul tension is provided by a line connected to the clew through a two part block disposed between the clew and a trolley on the boom, said trolley riding in and out along the boom as the clew moves in and out during reefing or letting out the sail. Means is provided for maintaining a desired tension on the downhaul line when the trolley is stationary, and for reducing the tension to a lesser amount when the trolley moves in response to clew movement.

DESCRIPTION OF THE ILLUSTRATED EMBODIMENT

General Arrangement

Referring to the drawing, there is illustrated a support and control system for a sail 10 which comprises a mast support 12, a mast 14 which is rotatably mounted on the support, and a cantilever boom 16 which is mounted on the mast support so as to be laterally rotatable about the mast axis through about 180 degrees. As will be more completely described hereinafter, the boom is swung to a desired position by port and starboard hydraulic winches 18 and 20 which pay out and take in port and starboard sheets 22 and 24. The mast is rotated in relation to the boom, to furl and unfurl the sail, and to position the luff of the sail for maximum aerodynamic efficiency by a hydraulic motor 26 which is mounted on a boom support cylinder 28, driving a gear 30 which meshes with a gear 32 on the mast.

Tension to the clew of the sail is applied through an outhaul line 34 and a downhaul line 36 in a manner to be described.

The Mast and Boom Support

Figure 4:
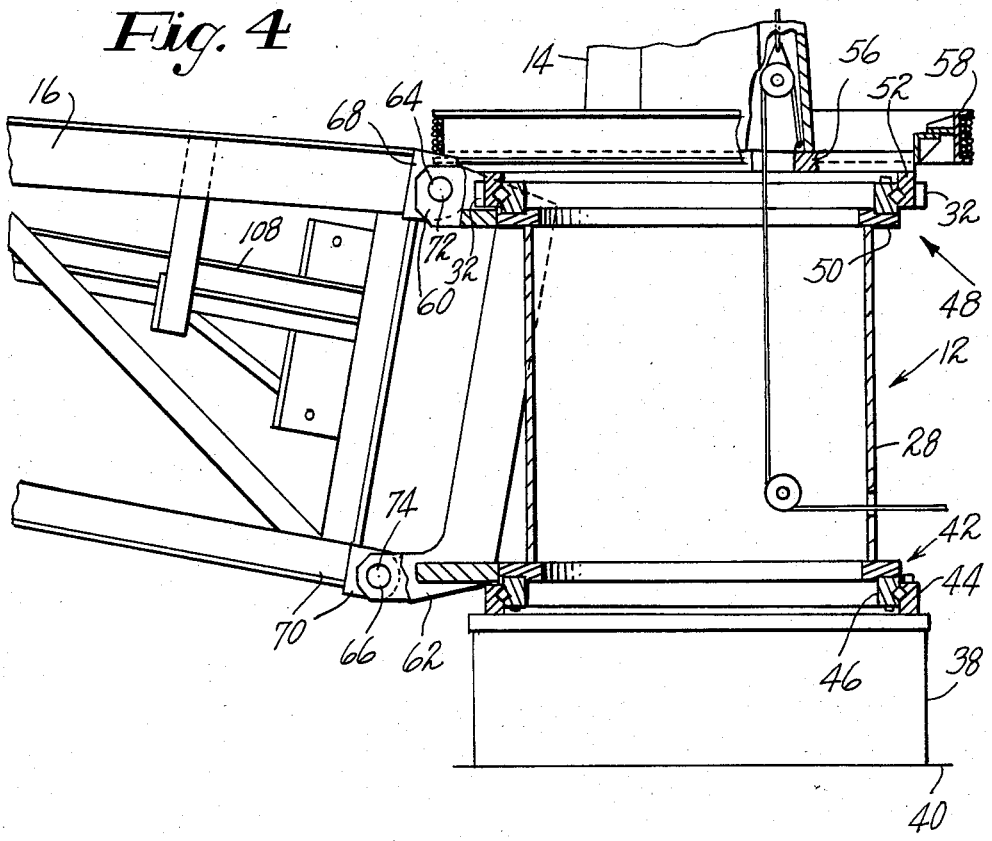
FIG. 4 is an enlarged view in side elevation, partly in section, of the mast and boom support structure.
Figure 5:
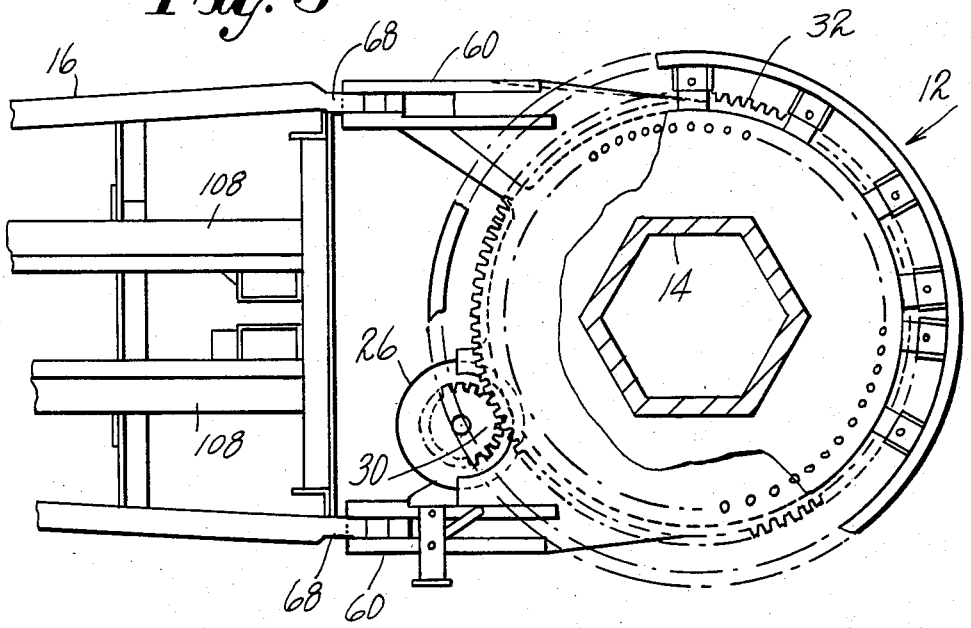
FIG. 5 is a top plan view of the structure of FIG. 4, with the mast in section.

Referring to FIGS. 4 and 5 there is illustrated the mast support assembly 12 which comprises a foot portion 38 secured to the deck 40 of the ship. A first slewing ring bearing 42 is mounted on the foot portion 38, with the outer race 44 thereof attached to the foot portion 38, and the inner race 46 being fastened to the boom support cylinder 28. A second slewing ring bearing 48 is mounted on the boom support cylinder 28 with the inner race 50 thereof attached to the top of the boom support cylinder. Th outer race 52 thereof carries an external gear 32 for a purpose to appear hereinafter.

Mounted on the outer race 52 is a plate 56, to which is mounted the mast 14 and an outhaul drum 58. The boom support cylinder 28 carries upper and lower boom support brackets 60 and 62 which have apertures 64 and 66 respectively to allow boom support arms 68 and 70 to be removably mounted thereon by pins 72 and 74.

The above described structure allows the boom support cylinder and boom to be rotatable in relation to the deck of the ship, through lower slewing ring 42, and allows the mast to be rotatable in relation to the boom through upper slewing ring 48.

During operation of the system, the boom is maintained in a desired angular relation to the ship by the sheet winches 18 and 20 in a manner to be described hereinafter, and the mast is rotated in a desired direction to furl or unfurl the sail by the mast rotating motor 26 and gear 30 driving the gear 32 on the outer race of the upper slewing ring. Since the boom is normally maintained in a fixed position, depending on the relative wind, operation of the motor 26 will cause rotation of the mast, to reef or let out the sail in a manner to appear hereinafter. Also, when the outhaul motor 26 is not operating, the boom and mast are locked together by the gears 30 and 32 so that if the boom 16 is swung to a different position, the mast rotates through the same angle as the boom, so that the amount of sail exposed does not change.

The mast can also be rotated, when the sail is fully unfurled, in either direction as necessary, to position the luff of the sail in the proper orientation in relation to the mast for the best aerodynamic efficiency, as will be described hereinafter.

The Boom Swinging Mechanism

Figure 2:
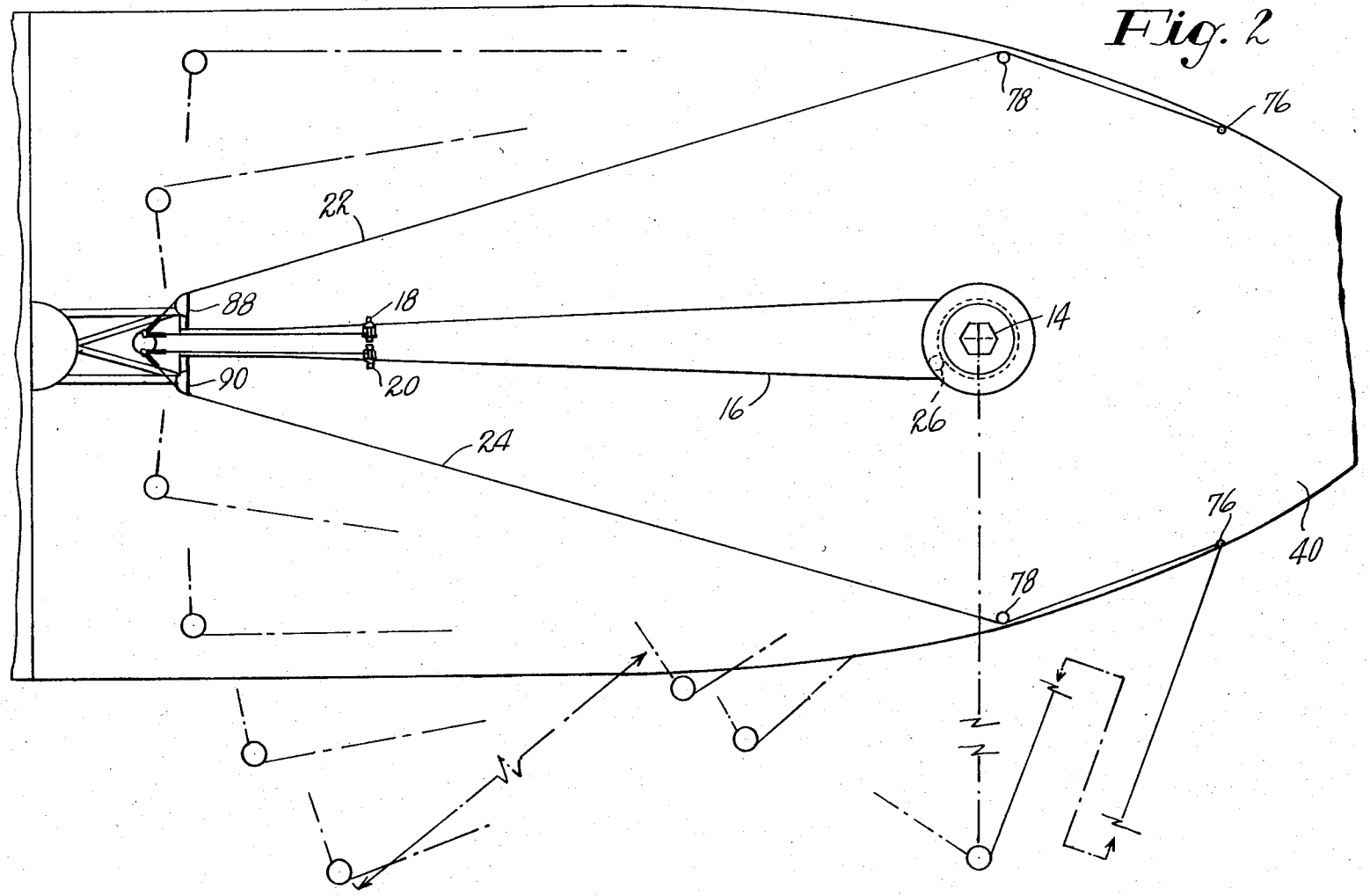
FIG. 2 is a top plan view of the rigging system of FIG. 1, illustrating the arrangement of the boom swinging mechanism, with certain other portions of the system omitted for clarity.
Figure 3:
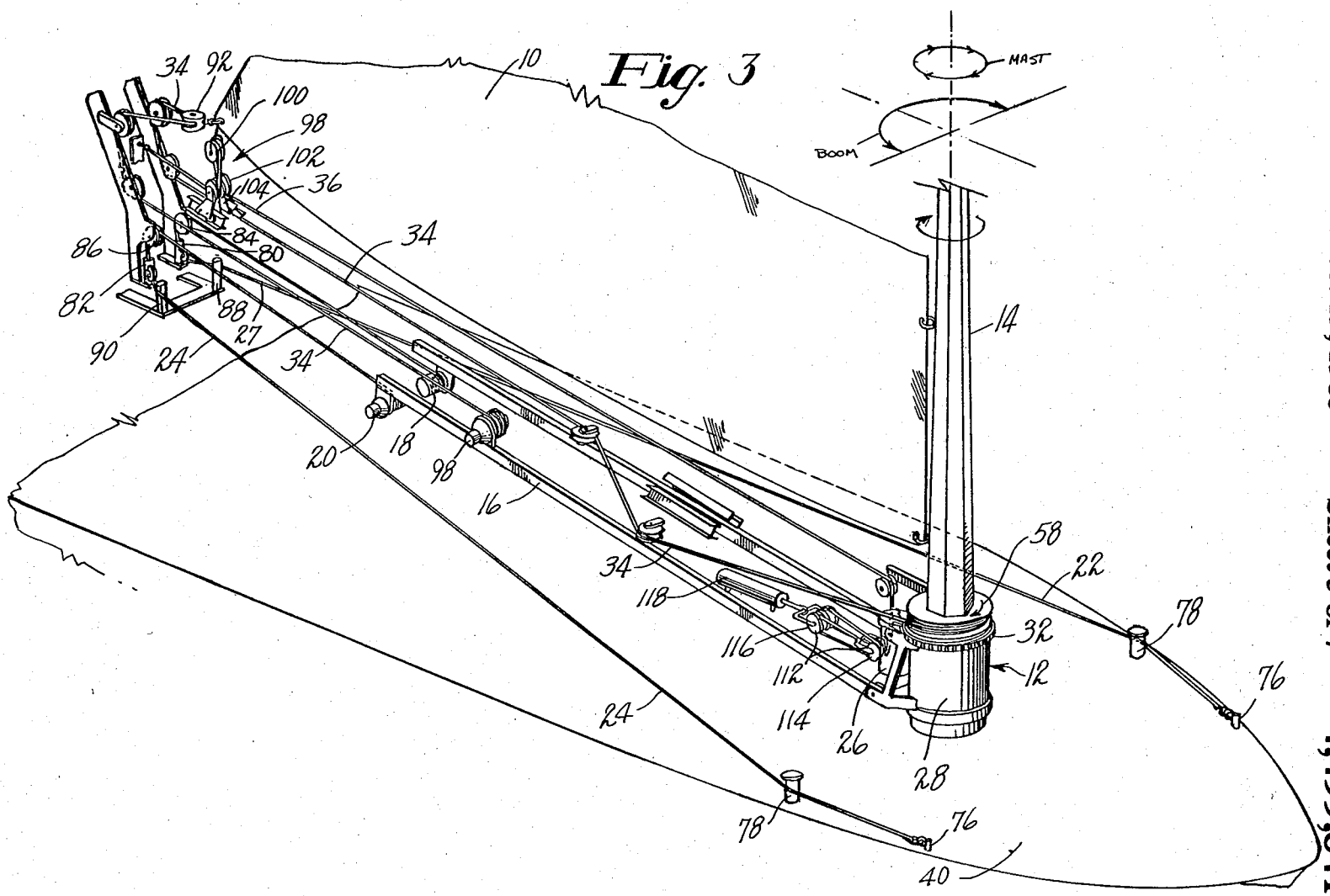
FIG. 3 is a perspective view of the system of FIG. 1 illustrating the boom swinging mechanism, the outhaul system, and the downhaul system, with other portions of the system omitted for clarity.

The position of the boom is controlled by the separate port and starboard sheet winches 18 and 20 which take in and pay out sheets 22 and 24 under controlled tension so that the position of the boom can be fixed. Each sheet is attached to a dead end 76 on the deck 40 forward of the mast (see FIG. 2) from where it passes around a fairlead post 78 on the deck approximately abeam of the mast. A pair of flag blocks 80 and 82 on the end of the boom lead the sheets to fixed sheaves 84 and 86, which lead the sheets to the sheet winches 18 and 20 on the boom. A pair of fairlead posts 88 and 90 are provided at the fore and aft position of the boom, so positioned that when the boom is swung out to starboard, for example, the port sheet passes outside of port fairlead 78 and behind the posts 88 and 90, so that the angle of the sheet to the boom is more favorable than if the sheet came directly from the port fairlead post 78. In the illustrated embodiment, the centerline fairlead posts may be mounted on the surface of a cargo crane support, however in other installations, they may be mounted on a platform of suitable height.

To swing the boom, the sheet winches 18 and 20 are operated independently so that one winch pays out one sheet and the other winch takes in the other sheet, with both sheets being under controlled tension. When the sheet winches are not being operated, the winch drums are locked against rotation, with tension on both sheets, so that the boom is prevented from swinging in either direction.

The Outhaul System

Figures 6, 7, 8:
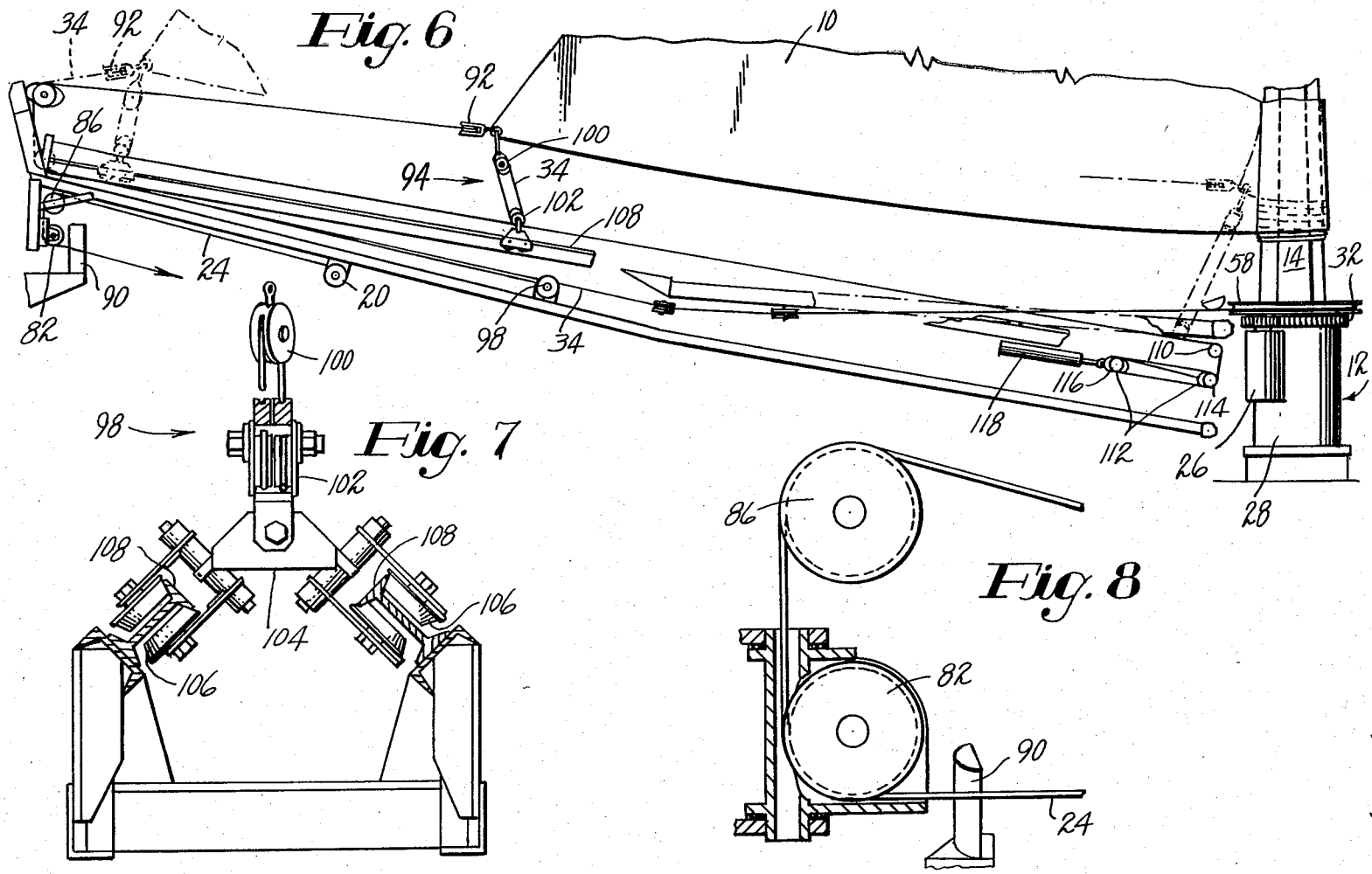
FIG. 6 is a view in side elevation of the structure of FIG. 1, illustrating the outhaul and downhaul systems, with the sail partially reefer.
FIG. 7 is an end view of a portion of the boom, illustrating the downhaul trolley and support.
FIG. 8 is an enlarged view in side elevation, partly in section, of a flag block of the boom swinging mechanism.
Figure 9:
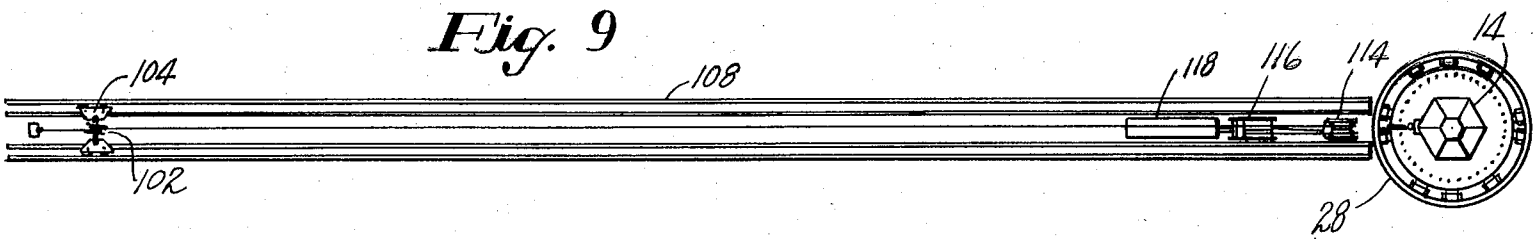
FIG. 9 is a plan view of the trolley support and downhaul system.
Figure 10:
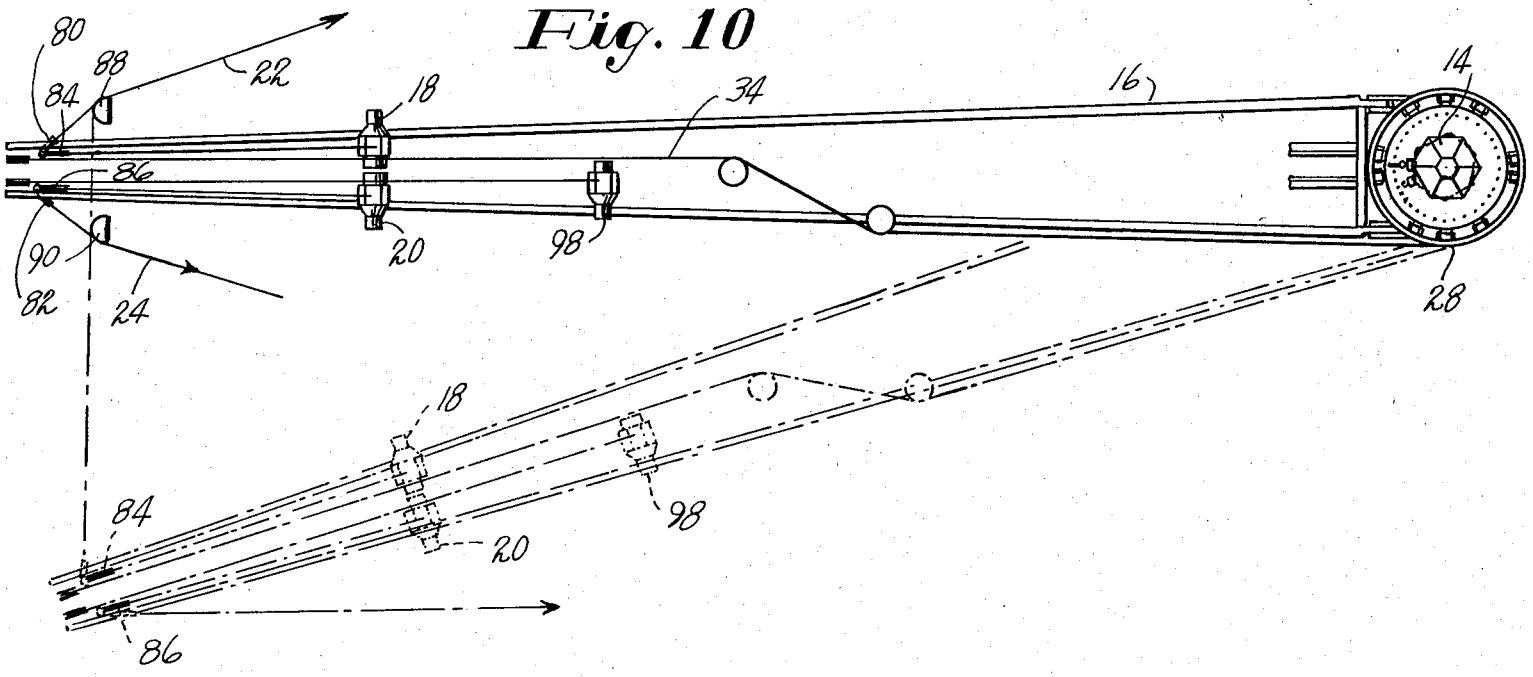
FIG. 10 is a top plan view of the boom illustrating the boom swinging mechanism and the outhaul winch, with an alternate boom position being shown in dashed line.

As previously mentioned, the sail is furled and unfurled by rotation of the mast by motor 26. The outhaul line 34 is secured to the furling drum 58 on the mast, and extends along the boom to the outer end thereof to a block system including a clew pulley 92 attached to the clew, and then to a tension winch 98 mounted on the boom. The outhaul drum 58 preferably has a diameter twice that of the mast. As illustrated in FIG. 6, rotation of the mast in a clockwise direction (as seen from above) by the motor 26 causes the sail to wrap onto the mast on the port side thereof, and causes the line 34 to unwind from the starboard side of the drum 58 at a rate twice the rate at which the sail winds onto the mast. However, because of the two part block 92, the clew pulley 94 of the two part block moves at the same rate as that at which the sail winds around the mast. The end of the outhaul line extends from the block system 92 to an outhaul tension winch 98. An important feature of the outhaul system is the fact that the tension winch 98 maintains a continuous tension on the outhaul line and hence on the clew of the sail, however no substantial amount of line is taken in or payed out by the tension winch. Therefore, the mast rotating motor need only overcome the friction of the moving components, and can be of lower horsepower than if it were required to pull the sail and apply the necessary tension thereto.

During furling and unfurling of the sail, the clew does not follow a path parallel to the boom but follows an arcuate path (see FIG. 6) due to the taper of the mast, therefore, as the clew moves from the end of the boom toward the mast, extra line is required in the system between the outhaul drum 58 and the clew pulley 94, which is provided from the outhaul tension winch 98. The winch 98 also adjusts the length of the outhaul line to compensate for sail stretching. In some cases, if the amount of the extra line required is not too great, a hydraulic cylinder could be used in place of the winch 98.

The Downhaul System

Downhaul tension is applied to the clew of the sail through a block system 98, comprising a single upper block 100 and a double lower block 102. The upper block 100 is secured to the clew of the sail, and the lower double block is secured to a trolley 104 which has rollers 106 riding under a track 108 on the boom 16.

The downhaul line 36 is dead ended at the outer end of the boom, passes around the block system 98, up the boom to a fixed sheave 110, and then to a block system 112 which comprises a fixed double block 114 and a movable double block 116 and is dead ended at the fixed double block 114, providing a 4 part line system with a mechanical advantage of 4. The movable double block 116 is fastened to the piston of a hydraulic cylinder 118, which provides tension to the downhaul system. With tension on the line 36, the upper and lower blocks 110 and 102 draw together, applying tension to the clew of the sail.

When it is desired to take in sail, prior to energizing the furling motor 26, the tension on the line 36 may be slightly reduced. This allows the trolley 104 to more easily travel inwardly when the clew of the sail moves inwardly on energizing the motor 26. The clew pulls the block system 98 inwardly along the boom, with the trolley rolling along the track 108. When the clew has reached the desired position, the mast rotating motor is stopped, and the tension in line 36 may then be increased to the amount necessary to maintain the clew the desired position in relation to the boom. The above described system allows adequate tension to be maintained in the clew even during taking in and letting out sail.

MISCELLANEOUS FEATURES

Figure 11:
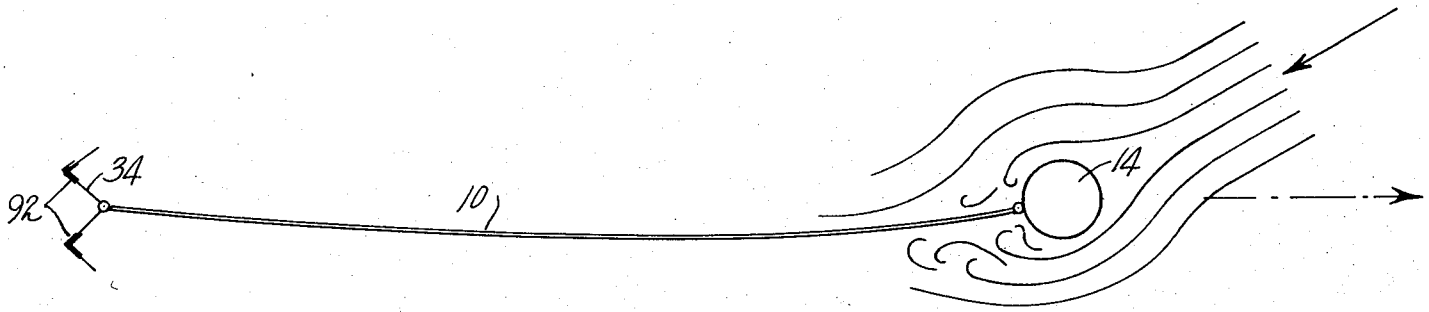
FIG. 11 is a schematic view of the sail and mast illustrating the air flow past the mast with the luff of the sail on the centerline of the mast in relation to the apparent wind.
Figure 12:
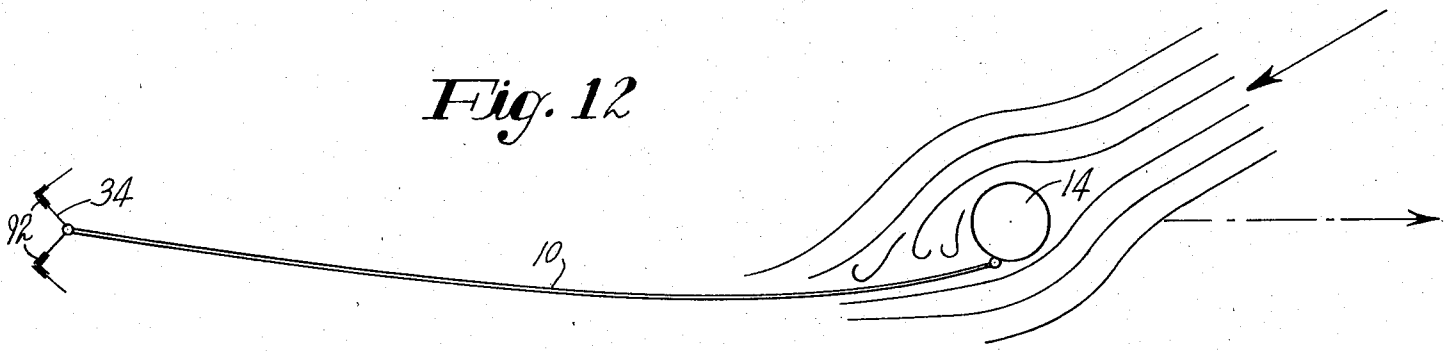
FIG. 12 is a view similar to FIG. 11 illustrating the air flow over the sail with the luff of the sail tangent to the mast periphery on the leeward side of the sail.

As previously mentioned, when the sail is completely unfurled, the boom may be rotated in either direction to position the luff of the sail in the best orientation for maximum aerodynamic efficiency, as illustrated in FIGS. 11 and 12. For example, when the apparent wind is 30 degrees off the port bow, the boom extends substantially fore and aft. If the orientation of the mast is such that the sail extends from the centerline of the mast, (see FIG. 11) the airflow around the mast causes turbulence on the forward portion of the lee side of the sail, preventing the establishment of the full pressure differential between the lee and weather sides of the sail.

However, if the mast is rotated to the position illustrated in FIG. 12 in which the leading edge of the sail is tangent to the leeward side of the mast, the smooth transition from the mast surface to sail surface allows non-turbulent flow over the leeward side of the sail, thereby improving aerodynamic performance.

Although in the illustrated embodiment of the invention, a pair of winches is provided on the boom, which handle separate port and starboard sheets, in some cases a single winch may be used with a single sheet which is continuous between the port and starboard dead ends.

Since certain other changes apparent to one skilled in the art may be made in the herein illustrated embodiment of the invention without departing from the scope thereof, it is intended that all matter contained herein be interpreted in an illustrative rather than a limiting sense.

I claim:

1. A mast and boom support assembly for a ship, comprising a lower bearing having two portions resistant to axial movement and rotatable in relation to each other, one portion being secured to a support fixed to the ship, the other portion being attached to the bottom end of a boom support member, an upper bearing having two portions resistant to axial movement and rotatable in relation to each other, one portion of said second bearing being fastened to the upper end of the boom support member, the bottom of the mast being attached to the other portion of the upper bearing, whereby the mast and boom support are rotatable about the mast axis independently of each other and bending forces applied to the boom support by the mast are resisted solely by the bearings.

2. An assembly as set out in claim 1 in which the bearings comprise inner and outer members rotatable in relation to each other, the outer member of the lower bearing being attached to the support, the outer member of the upper bearing being attached to the mast, the inner members of the bearing being attached to the upper and lower ends of the boom support member, and first drive means is provided acting between the members of the upper bearing to cause, when operating, rotation therebetween to cause rotation of the mast in relation to the boom support, and second drive means is provided acting between the members of the lower bearing to cause, when operating, rotation of the boom in relation to the ship, each of the drive means, when not operating, locking the associated bearing members against rotation, whereby operation of the first drive means only causes rotation of the mast without rotation of the boom support in relation to the ship, and operation of the second drive means only causes simultaneous rotation of the boom support and the mast, whereby rotation of the boom by the second drive means does not change the amount of sail exposed.

3. An assembly as set out in claim 1 in which the outer member of the upper bearing carries an external gear, and the boom support carries a motor driving a gear which is meshed with the external gear.

4. An assembly as set out in claim 1 in which said boom support carries upper and lower boom support arms to allow assembly of the boom thereon.

5. An assembly as set out in claim 1 in which mast rotating means is provided acting between the mast and the boom support to cause rotation of the mast in relation to the boom support when said mast rotating means is operating, said mast rotating means being capable of locking the mast against rotation in relation to the boom support when it is not operating.

6. A mast and boom support assembly for a ship, comprising a boom support having a cylindrical member, upper and lower slewing bearings having inner and outer relatively rotatable members, the inner members of the upper and lower bearings being attached to the upper and lower ends of the cylindrical member, the upper bearing having a gear on the outer member, a mast mounted on the outer member, a motor mounted on the boom support, a gear driven by the motor and meshing with the external gear, whereby the mast is rotated in relation to the boom support when the motor is operated and the mast is locked against rotation in relation to the boom support when the motor is not operating.

7. A sail support system for a ship, comprising a support fixed to the ship so as to be non-rotatable in relation thereto, a boom support rotatably mounted on the fixed support, a mast rotatably mounted on the boom support, mast rotating means acting between the boom support and the mast to cause rotation of the mast in relation to the boom support, and boom rotating means acting between the ship and the boom support to cause rotation of the boom support in relation to the ship, whereby said mast rotating means also causes rotation of the mast with the boom when the boom is rotated.

8. A sail support system as set out in claim 7 in which when the boom rotating means is not operating to rotate the boom, it locks the boom from rotation in relation to the ship, and when said mast rotating means is not operating to rotate the mast, it locks the mast from rotation in relation to the mast support.

* * * * *